US005233932A

United States Patent [19]

Robertson

[11] Patent Number: 5,233,932

[45] Date of Patent: * Aug. 10, 1993

[54] SHREDDER/COMPACTOR AUGER SYSTEM

[75] Inventor: James C. Robertson, Mabelvale, Ark.

[73] Assignee: Ensco, Inc., Little Rock, Ark.

[ * ] Notice: The portion of the term of this patent subsequent to Jun. 11, 2008 has been disclaimed.

[21] Appl. No.: 823,191

[22] Filed: Jan. 21, 1992

[51] Int. Cl.[5] ..... F23K 1/00

[52] U.S. Cl. ..... 110/232; 110/101 R; 110/222; 110/186; 110/347; 241/31; 241/DIG. 14

[58] Field of Search ..... 110/232, 101 R, 222, 110/347, 186, 108; 241/25, 31, DIG. 14

[56] References Cited

U.S. PATENT DOCUMENTS 4,245,790 1/1981 Williams ..... 241/31

5,022,328 6/1991 Robertson ..... 110/232

*Primary Examiner*—Edward G. Favors

*Attorney, Agent, or Firm*—Keaty & Keaty

[57] ABSTRACT

A shredding and feeding system for an incinerator, wherein a shredding chamber is isolated from atmosphere by means of an airlock through which material to be incinerated passes into the shredding chamber. The oxygen content of the shredding chamber is maintained below a predetermined level to minimize risk of explosions and premature incineration of material.

22 Claims, 4 Drawing Sheets

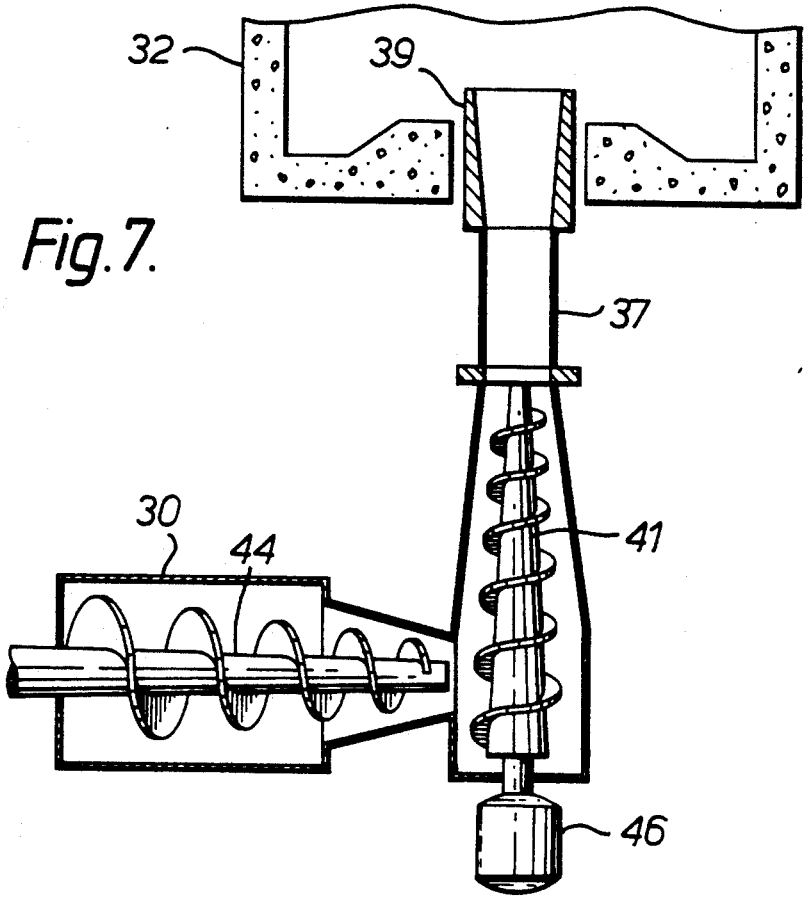
Fig. 7.
Fig. 8.
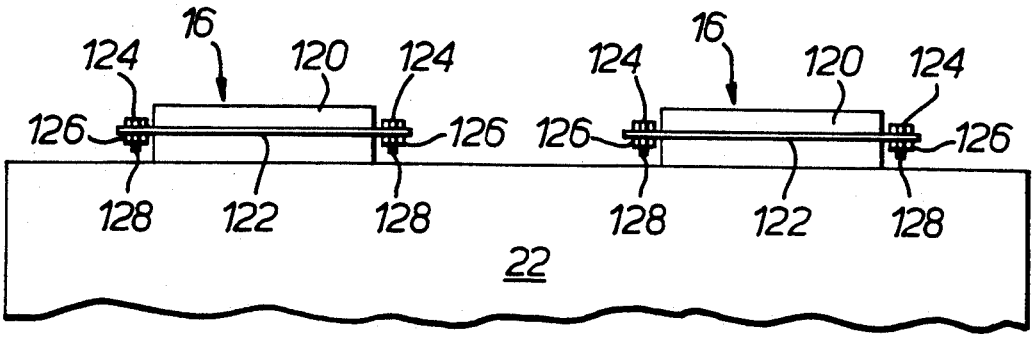

SHREDDER/COMPACTOR AUGER SYSTEM

BACKGROUND OF THE INVENTION

The present invention is generally directed to systems for pyrolysis of hazardous materials. More specifically the invention is directed to systems for feeding hazardous materials to a combustion chamber, or kiln.

The incineration of hazardous waste materials within the United States is closely controlled and monitored by the U.S. Environmental Protection Agency. In connection therewith, the U.S. environmental Protection Agency has issued strict guidelines for the construction of hazardous material incinerators and systems for feeding such material to the incinerators. As a result, a variety of systems have been developed for feeding such materials to the incinerators.

In many of the known systems, there is the possibility that the material to be incinerated can prematurely combust and cause fires, explosions, and the like. This can damage the equipment and can be a safety hazard to supervisory personnel.

SUMMARY OF THE INVENTION

The present invention provides an improved system for decompacting or shredding and feeding compacted or packaged hazardous materials into a combustion chamber. Further, the invention provides that the decompaction occurs in an environment that reduces the risk of premature combustion.

To these ends, the invention provides a hazardous waste shredder/feeder system for a kiln, or incinerator, wherein the waste is first conveyed to an airlock chamber and introduced therein, then conveyed from the airlock chamber to a shredding chamber, and then conveyed from the shredding chamber to a feeding chamber from whence it is fed into the kiln, or incinerator. The airlock chamber serves to isolate the shredding and feeding chambers from outside air.

The following words are used interchangeably throughout the specification and claims: kiln, combustion chamber, incinerator, and pyrolysis chamber. No limitation in meaning is intended by the use of one word instead of another unless otherwise noted.

Further, the following words and their conjunctions are also used interchangeably throughout the specification and claims: burn, combust, incinerate, and pyrolysis. No limitation in meaning is intended by the use of one word instead of another unless otherwise noted.

Yet further, when used herein, the word conveyor is to be read broadly as encompassing any means for conveying unless otherwise qualified.

The invention provides in an exemplary embodiment, a shredder/feeder system that automatically and sequentially moves combustible material, preferably palletized hazardous wastes contained either in drums, pails, crates or boxes from a ground level material mover (normally being a fork lift), and into an elevator conveyor via a first conveyor, which can be a roller, slat or any other suitable type conveyor. The elevator then lifts the hazardous waste material to an upper level discharge point, at which point the material is transferred to a second conveyor or conveyors. The hazardous waste material advances on the second conveyor/conveyors until it is in line with a hermetically sealed air lock chamber. At that point, an automated mechanism moves the material onto a third conveyor that may be oriented 90 degrees to 180 degrees from the second conveyor/conveyors.

The third conveyor moves the material through an automated guillotine entry door into the airlock chamber. Once the material has entered the airlock chamber, a suitable control system closes the guillotine entry door and initiates a purge of oxygen in the airlock chamber, wherein a gas, preferably nitrogen, replaces evacuated oxygen, or air. An internal oxygen sensor initiates shut down of the purge when a predetermined oxygen concentration is reached. The purged oxygen air exits the airlock chamber via a conduit leading to a combustion air blower. When the purge is shut down, a control system opens a guillotine exit door to permit further travel of the hazardous material from the airlock chamber into a shredder chamber.

The third conveyor at that time moves the material from the airlock chamber to the shredder chamber by conveying the material until it falls off one end of the conveyor. When the pallet of hazardous material has fallen into the shredder chamber, the control system closes the second guillotine door to isolate the shredder from atmosphere. Then suitable shredder or shredders operates to shred the waste material for a predetermined time cycle in an upper portion of the chamber. The shredder waste charge is allowed to fall into a lower feeder auger, which then extrudes the material into the combustion chamber.

The shredder/feeder chamber contains several oxygen analyzers which continuously monitor oxygen concentration. In the event oxygen concentration exceeds a predetermined level, the control system automatically stops all equipment operation and closes an isolation door to keep waste charge material from entering the combustion chamber.

During such an event, the purge is activated, wherein nitrogen gas is introduced and continues until the oxygen concentration is reduced to a predetermined level. When this occurs, the control system opens the isolation door and the system is reactivated to deliver the shredder waste material to the combustion chamber.

Further, to prevent the entire system from an internal explosion, the present invention, provides for the use of a means for relieving internal pressure, when such pressure exceeds a predetermined value. This pressure relief means is operationally connected with the shredder/feeder chamber. The structure of the pressure relief means has an added advantage of preventing leaks of nitrogen and fugitive emissions into the surrounding atmosphere.

Thus, safer processing of combustible hazardous materials is accomplished by the isolation of hazardous materials from atmosphere during processing and by safely processing flammable and low flashpoint solid, semi-solid and sludge type waste without repackaging, thereby eliminating employee exposure and costs of repackaging.

The invention accomplishes safely shredding low flash point wastes and provides a continuous stable feed to a kiln therein providing more stable kiln operating conditions.

By providing a shredded flammable waste feed to a kiln, burnout and kiln capacity is improved in both oxidizing and pyrolysis modes of kiln operation.

The method of feeding solid and semi-solid combustible wastes continuously to a kiln is totally automated and an explosion proof atmosphere is maintained in the airlock and main feed chamber.

These and other features and aspects of the present invention will become more apparent with reference to the following detailed description of the presently preferred embodiments and accompanying drawings.

BRIEF DESCRIPTION OF THE DRAWINGS

FIG. 7 is a plan view of an alternate feeding arrangement for the systems of FIGS. 1 and 2 wherein a shredder/auger machine is oriented 90 degrees to a center line of a combustion chamber with an additional feed auger/shredder positioned on the center line of the combustion chamber.

FIG. 8 is a schematic of a pressure relief means of the shredder/feeder chamber.

DETAILED DESCRIPTION OF THE PRESENTLY PREFERRED EMBODIMENTS

Figure 1:
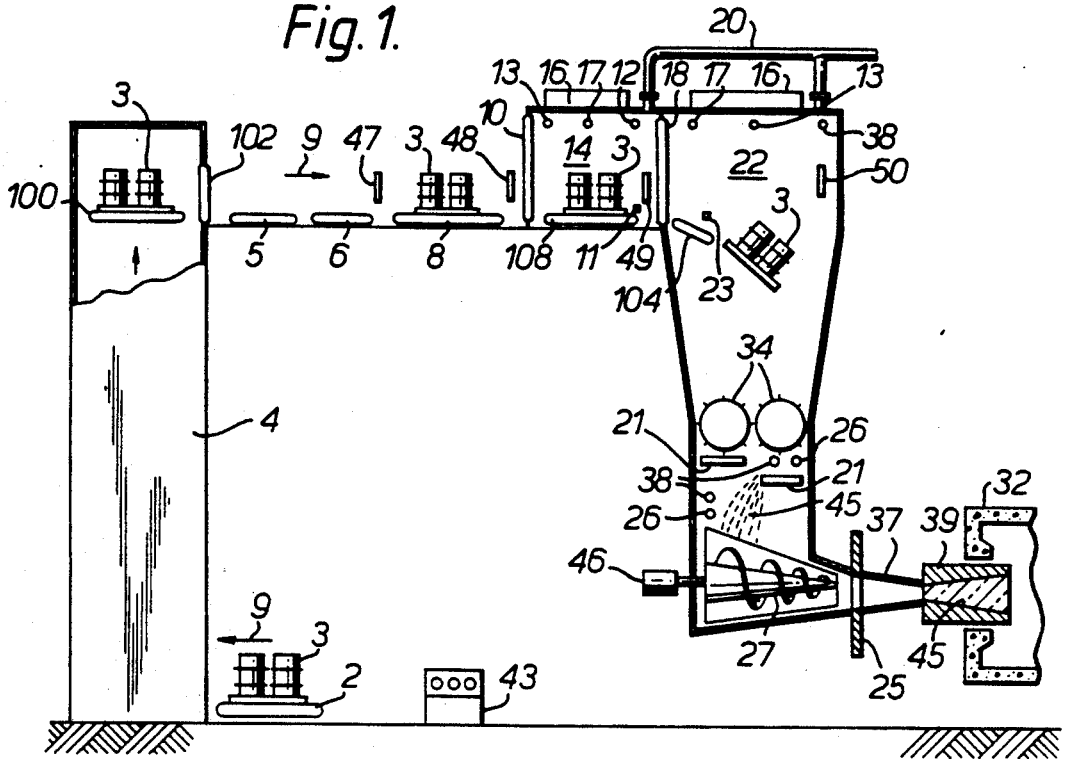
FIG. 1 is a schematic of an arrangement embodying principles of the invention.
Figure 2:
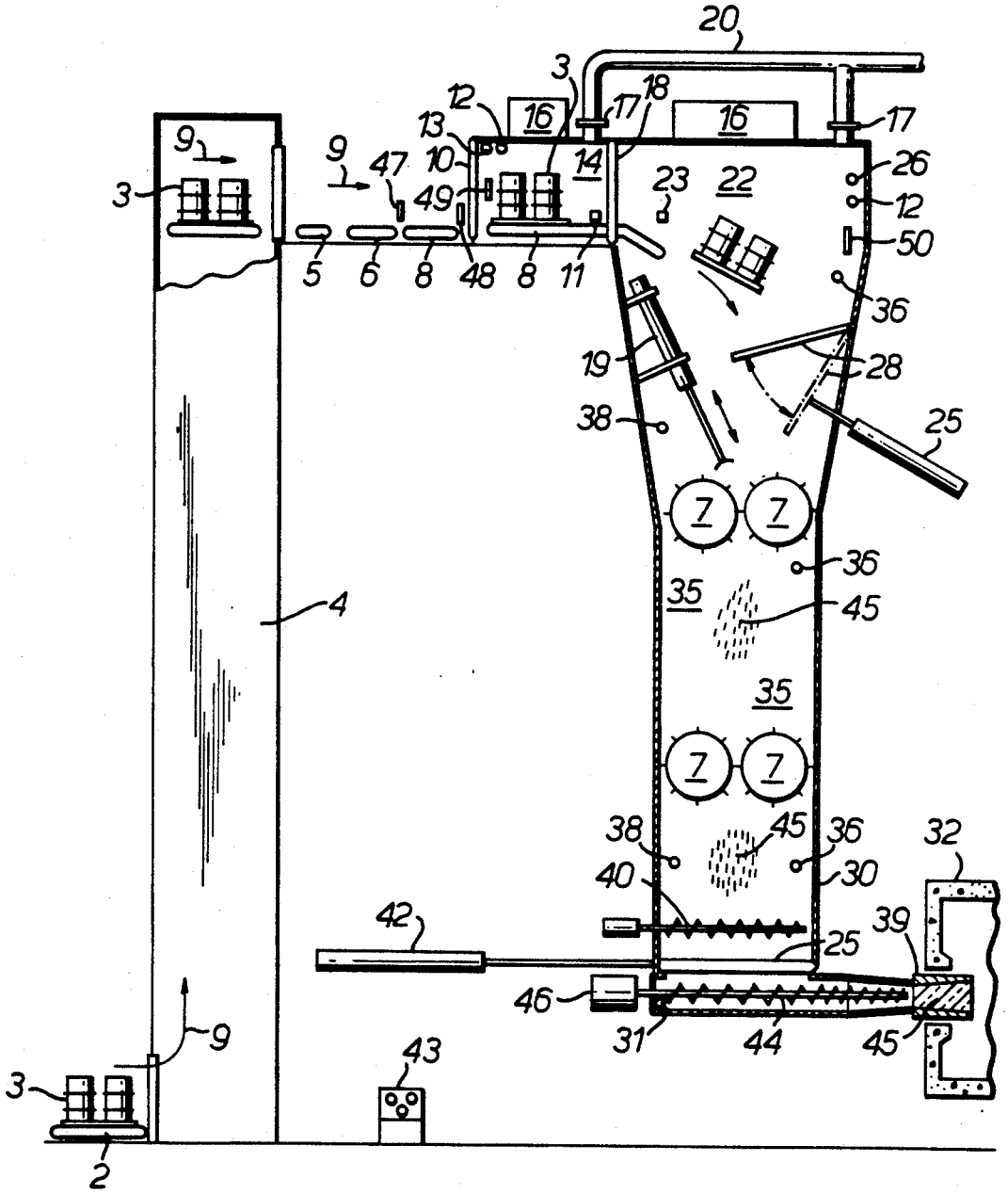
FIG. 2 is a schematic of another arrangement embodying principles of the invention.

In FIGS. 1 and 2 there are illustrated two arrangements embodying principles of the invention. In the illustrated arrangements, material, preferably, palletized hazardous waste charge, is conveyed to a combustion chamber via an isolated shredding operation. Accordingly, because the shredding operation is isolated from the remainder of the arrangement, the material can be safely transported into the combustion chamber with a reduced risk of explosions and the like.

Figure 5:
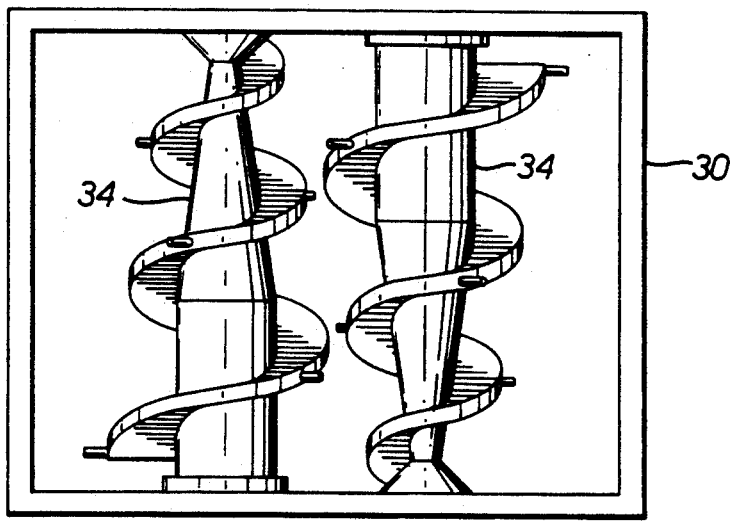
FIG. 5 is a cut-away plan view illustration of a feed chamber for grinding and augering material and feeding same to an Auger/Feeder chamber.
Figure 6:
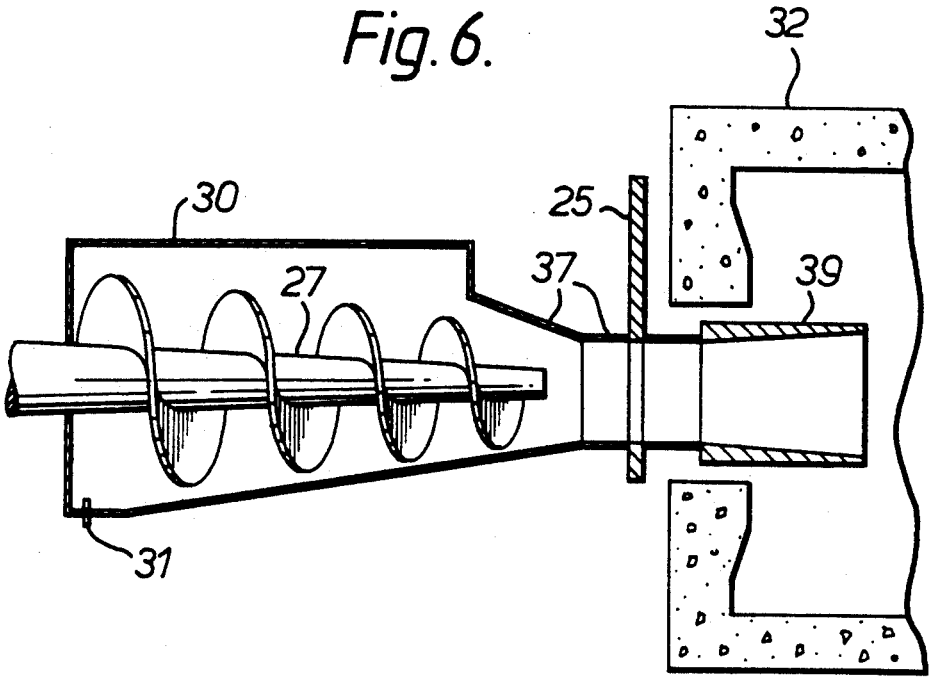
FIG. 6 is an elevational view of an auger feeder used to feed combustible material into a combustion chamber.

As illustrated in FIGS. 1, 5 and 6 in one presently preferred embodiment, combustible material 3, preferably palletized hazardous material, which can be contained in steel drums (as illustrated) is conveyed along a path to a kiln 32, as indicated by arrows 9. In the process, the material 3 is isolated from oxygen and shredded, or decompacted.

To this end, a ground level conveyor 2, which can be a roller, slat or any other suitable type conveyor, is used to transfer the material 3 onto a vertical conveyor 4. The material 3 is elevated above ground level by the vertical conveyor 4 and transferred onto a conveyor 100, which can be a roller, slat or any other suitable type conveyor, at a top terminal of the vertical conveyor 4. The conveyor 100 then transfers the material 3 to another conveyor 5, the vertical conveyor 4 housing. Of course, the conveyor 100 can be a part of the vertical conveyor 4.

The material 3 is then transferred along a series of conveyors, commencing with the conveyor 5 and including conveyors 6, 8, 108 and 104 along the direction defined by an arrow 9. It is to be understood, however, that the number of conveyors used can vary depending on the particular needs of a given arrangement. The important thing is to provide transport of the material 3. This can be accomplished using one or more conveyors.

With continuing reference to FIG. 1, it can be seen that the material 3 is transferred from the conveyor 5 to the conveyor 6. Once the material 3 reaches the end of the conveyor 6, it is sensed by a first control system 47 which stops the conveying of the material 3. In a preferred embodiment, the conveyor 6 comprises a 90 degree transfer station. Once the material 3 is stopped on the conveyor 6, it is transferred onto yet another conveyor 8 at which point transport of the material 3 continues.

When the material 3 reaches the end of conveyor 8, it is sensed by control system 48 which is operatively connected to entry door 10 of airlock chamber 14. Door 10 preferably is of the guillotine type which opens and closes a doorway by raising and lowering of the door 10.

With the door 10 in its open position, the material 3 is transferred to a feed conveyor 108 located within the airlock chamber 14. A sensor 11, preferably a limit switch positioned adjacent to the conveyor 108 is used to sense the presence of the material 3 within the airlock chamber 14. When the sensor 11 senses the material 3 within the airlock chamber 14, the conveyor 108 is temporarily halted, so that a purge of oxygen can take place and the door 10 is closed.

To effect a purge of oxygen once the door 10 is closed, a third control system 49 activates a purge, whereby oxygen is replaced by a suitable gas, e.g., nitrogen gas, which gas is introduced into the airlock chamber 14 via purge lines 13 and air is evacuated from the airlock chamber 14 and an adjacent main feeder chamber 22 via a conduit 20. The conduit 20 is connected to a combustion air blower (not illustrated) associated with the kiln 32. Thus, the air evacuated from the airlock chamber 14, and main feeder chamber 22 is provided to the kiln 32.

At the same time, the suitable gas, e.g., nitrogen, is introduced into the airlock chamber 14 and main feeder chamber 22 via purge lines 13. Oxygen sensors 12 continuously monitor the concentrations of oxygen in the atmospheres within the airlock chamber 14, and main feeder chamber 22. When the concentration of oxygen insufficiently low, the oxygen purge is terminated by the control system 49.

The elimination of oxygen within the sealed airlock chamber 14 and main feeder chamber 22 serves to prevent the occurrence of premature combustion of the material 3 via explosions, fires, or the like. Should this occur, however, a fire suppressing system, 17, preferably a sprinkler or foaming system is provided. In order to prevent the entire system form an internal explosion in case of a sudden increase in pressure within the main feeder chamber 22, the present invention contemplates provision of a pressure relief means 16, which is operationally connected with the chamber 22.

The pressure relief means 16 comprises one or more rupture disk assemblies 120 which are in fluid communication with the chamber 22. Each of the assemblies 120 has a thin membrane, or sheet 122, which is held into place between two parallel flanges 124, 126 secured together by conventional means, such as for example, securing bolts 128.

The assemblies 120 serve as a weak link in the system, since the membrane 122 is made from a material which is selected from a type designed to rupture in the event of a sudden pressure increase. At the same time, the assemblies 120 form a positive seal at pre-determined operating pressures, preventing escape of nitrogen and contaminating fugitive emissions.

When the oxygen purge is terminated, the control system 49 opens airlock chamber exit door 18. Exit door 18 preferably is also the guillotine type which can be raised and lowered to open and close, respectively, an exit doorway. The feed conveyor 108 is then activated and the material 3 is transported to conveyor 104 which is positioned within the main feeder chamber 22. The guillotine entry door 10 remains closed, and thus, the airlock chamber 14 and main feeder chamber 22 remain isolated from atmosphere.

As illustrated, the conveyor 104 transport the material 3 until it falls off the end of the conveyor 104. Since the end of the conveyor 104 preferably extends to about a center of the main feeder chamber 22, the material 3 preferably falls along a central vertical line of the main feeder chamber 22. As it falls, the material 3 activates a sensor 23, preferably tripping a limit switch, which in turn is coupled to the control system 50. The control system 50 reacts by closing the exit door 18 to isolate the main feeder chamber 22 from the airlock chamber 14, so that another charge of material can be introduced into the airlock chamber 14.

The material 3 falls from the conveyor 104 into a shredder 34 which shreds the material 3, as well as the drum in which it is contained, if any, and the pallet on which the drum is carried, if any. It should be appreciated that the shredder 34 preferably has sufficient power and strength to shred wooden pallets as well as steel drums.

The shredder 34 preferably comprises two parallel flighted opposing cone augers having radial knives or teeth disposed thereabout. The material 3 (and drums and pallets in which it is contained and on which it is mounted) is continuously sliced and ripped by the knives for a predetermined cycle. To this end, the material 3 (and drums and pallets) is held in contact with the shredder 34 by means of doors 21.

Following termination of the shredding cycle, the doors 21 open and allow shredder matter 45 to fall into an auger 27 contained within a chamber 30. The auger 27, by auger action, will further shred the shredded material 45. At the same time, the auger 27 will extrude the shredded matter 45 through a constrictive throat 37, with surrounding water cooled injection tube 39, and into kiln 32. The auger 27 is illustrated in greater detail in FIGS. 5 and 6.

As illustrated, the auger 27 preferably is tapered such that the matter 45 is forced into a continuously decreasing diameter conduit, so as to compact the matter as it is extruded into the kiln 32. Further, the auger 27 preferably comprises two parallel augers 27A and 27B, so that the matter 45 is further shredded and mixed.

To increase safety in operation of the illustrated apparatus, a plurality of oxygen sensors 38 are positioned between the discharge of the shredder 34 and the inlet of auger 27. These oxygen sensors 38 are positioned between the discharge of the shredder 34 and the inlet of auger 27. These oxygen sensors 38 are operatively coupled and serve to signal the control system 50 when ever the oxygen concentration in that area exceeds a predetermined safety level.

Whenever the oxygen sensed by the sensors 38 exceeds the predetermined safety level, the control system 50 preferably halts operation of all operating equipment and initiates an oxygen purge. To this end, the control system 50 closes a kiln isolation door 25 and a suitable gas such as nitrogen is introduced into the chamber 22 via suitable ports 26.

Once the oxygen concentration is reduced to a level below the safety level, the purge is terminated, the kiln isolation door 25 is opened, and the remaining operating equipment is restarted.

To effect control over the entire arrangement, a control system 43 is provided. The system 43 preferably includes an interface panel by which supervisory personnel can monitor and control the various devices used to convey, shred, and feed material to be consumed in the kiln 32. The system 43, therefore, preferably communicates with and interacts with the other control systems 47, 48, 49, and 50.

Figure 4:
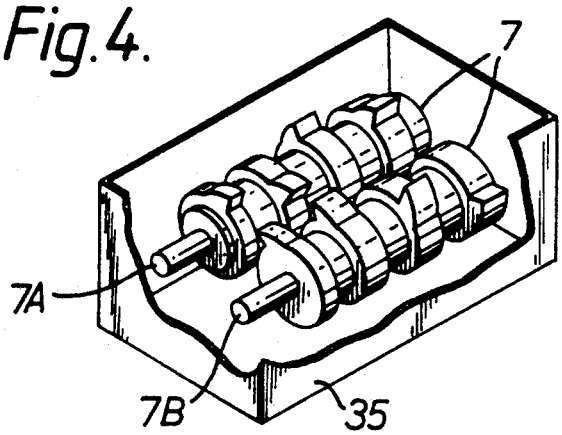
FIG. 4 is a cut-away isometric view of shear shredders and chamber of the arrangement of FIG. 2.
Figure 3:
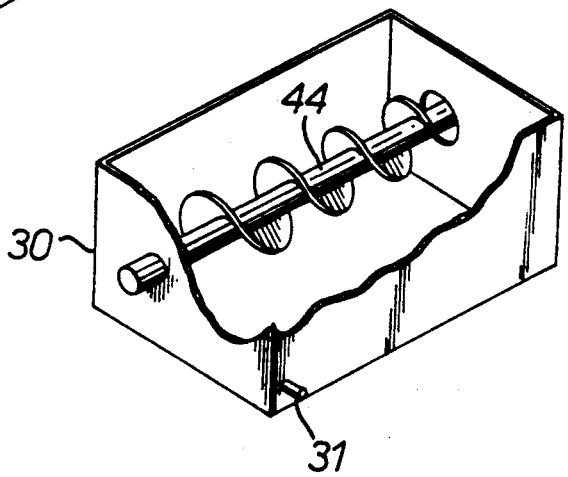
FIG. 3 is a cut-away isometric view of an auger chamber of the arrangement of FIG. 2.

In FIGS. 2–4, there is illustrated another arrangement embodying principles of the invention. It can be appreciated that many aspects of the arrangement of FIG. 2 are similar to than to FIG. 1 and accordingly, similar components are referenced by identical reference numerals.

As illustrated, the process for conveying the material from ground to the main feeder chamber 22 in the arrangement of FIG. 2 is similar, if not identical, to that described in connection with FIG. 1. Accordingly, a description of that portion will not be repeated. It should be noted, however, than conveyors 108 and 104 of FIG. 1 are combined as a single continuous conveyor 108 in FIG. 2. Otherwise the process is identical.

In the arrangement of FIG. 2, the material 3 that falls off the end of the conveyor 108 falls onto a swing gate 28 rather than directly onto a shredder 7 (which is similar to the shredder 34). The swing gate 28 is operatively moved by a ram 25 between upper and lower positions. In its upper position, the gate 28, preferably a substantially planar swinging door, is substantially horizontally positioned. In contrast, in its lower position, the gate 28 is substantially vertically positioned so that material thereon slides off. It should be understood that the material 3 is dropped onto the swing gate 28 when it is in its upper positions, and then the gate 28 is lower to allow the material 3 to slide off and to drop between the rollers of the shredder 7.

Thus, the swing gate 28 can serve to control the feeding of material 3 to the shredder 7 and to lessen the impact force of the material 3 as it falls into the shredder 7 as the material 3 falls form a lower height.

Also included in the arrangement of FIG. 2 is a reciprocating hydraulic ram 19 than includes a pusher arm 19A. The ram 19, by operatively moving the arm 19A toward and away from the shredder 7 can serve to ensure than the material 3 is positively feed between the rollers of the shredder 7. The gate 28 and ram 19 are automatically controlled by control system 50.

The shredded matter 45 that exits from the shredder 7, falls into chamber 35 and into a second shredder 107 that, preferably, is identical to the shredder 7. At that point, the matter 45 is re-shredded by the shredder 107. The matter 45 is then discharged from the shredder 107 and into an auger 44 that serves to feed the shredded matter 45 into the kiln 32. As illustrated, an agitator 40 and plural nitrogen cannons 31 are installed in a lower vertical drop chute 30 that extends between the shredder 107 and the auger 44. The agitator 40 and nitrogen cannons 31 serve to promote the flow of shredded matter 45 to the auger 44.

As with the arrangement of FIG. 1, the arrangement of FIG. 2 includes multiple oxygen sensors 38 in the chamber 35, which serve to provide signals to a control system 43, if the oxygen concentration within the chamber 35 rises above a predetermined safety level. If the oxygen level in the chamber 35 is above the predetermined safety level, the control system 43 can stop all equipment and close the kiln isolation door 25 and commence an oxygen purge. Again, once the oxygen concentration is reduced below the safety level, the purge is terminated and the kiln door 25 is reopened.

In FIG. 3 the preferred auger 44 is illustrated in isometric view. Additionally, the relative positioning of a nitrogen cannon 31 can be seen.

In FIG. 4, an isometric view of the shredder 7 is illustrated. It can be seen that the shredder basically comprises two parallel rollers 7A and 7B. Each of rollers 7A and 7B preferably comprises a series of circular disk members with protruding teeth. The series of disk-like members are separated by short cylindrical members, so that the disk-like members are spaced apart along an axis of rotation. Further, the teeth of the disk-like members are positioned out of axial alignment, so that they do not rotate through a common axial line at the same time. Instead, the teeth will dig into the matter to be shredded at different times.

However, it should be understood that the shredder 7 merely represents a preferred embodiment. It is possible to replace the shredder 7 with another suitable type of shredder that effectively shreds and tears apart the material 3 and any accompanying pallet and drum.

Further, it can be appreciated that the shredder illustrated in FIG. 4 can also be employed as the shredder 34.

FIG. 7 illustrates in plan view an alternate arrangement for feeding shredded matter 45 into the kiln 32. As illustrated, a first single tapered auger 41 is provided for the actual extrusion of matter 45 into the kiln 32. Positioned at right angles to the auger 41 is a second, larger, tapered auger 27. It can be appreciated that the shredded matter 45 will be able to fall more easily into the space provided by the larger auger 44. Then, the auger 27 will compress the matter 45, so that it is more easily received by the smaller auger 41.

While a preferred embodiment has been shown, modifications and changes may become apparent to those skilled in the art which shall fall within the spirit and scope of the invention. It is intended that such modifications and changes be covered by the attached claims.

I claim:

1. An apparatus for burning a combustible material, comprising:

a kiln;

an airlock chamber; and shredding and conveying apparatus for shredding and conveying combustible material and having an enclosure means operatively coupled between said kiln and said airlock chamber, said apparatus further comprising a means for relieving internal pressure in fluid communication with said enclosure means, said pressure relief means preventing escape of gases from the enclosure means at predetermined operating pressures; and means for controlling the oxygen content of said enclosure means whereby combustible material is shredded and conveyed into said kiln in an atmosphere whose oxygen content is maintained below a preselected level.

2. The apparatus of claim 1, wherein said apparatus for shredding and conveying comprise a pair of rotating shredders through which said combustible material falls under the influence of gravity.

3. The apparatus of claim 1, wherein said apparatus for shredding and conveying comprises an auger having one end in communication with said kiln.

4. The apparatus of claim 1, wherein said airlock chamber comprises means forming a chamber with an inlet door through which said combustible material is introduced into said airlock chamber and an outlet door through which said combustible material is discharged into said shredding and conveying apparatus, so that said shredding and conveying apparatus does not communicate with atmosphere.

5. The apparatus of claim 1, wherein said airlock chamber includes a purge system whereby oxygen can be purged from within said airlock chamber and replaced with a non-combustible gas.

6. The apparatus of claim 5, wherein said purge system is charged with a non-combustible gas consisting of nitrogen.

7. The apparatus of claim 1, wherein said shredding and conveying apparatus includes a purge system, whereby oxygen can be purged from said enclosure means and replaced by a non-combustible gas.

8. The apparatus of claim 7, wherein said purge system is charged with non-combustible gas consisting of nitrogen.

9. The apparatus of claim 1, wherein said airlock includes a conveyor for conveying said combustible material therethrough.

10. The apparatus of claim 1, further comprising at least one other conveyor for conveying said combustible material into said airlock chamber.

11. The apparatus of claim 10, wherein said conveyor includes a vertical conveyor for conveying combustible material into said airlock chamber.

12. The apparatus of claim 1, wherein said pressure relief means comprises at least one rupture disk assembly.

13. The apparatus of claim 12, wherein said at least one rupture disk assembly comprises a membrane sheet secured in place by a pair of parallel flanges.

14. An apparatus for incinerating material, comprising:

a kiln;

an enclosed apparatus for shredding and conveying material into said kiln having an outlet operatively coupled to said kiln, said apparatus comprising a means for relieving internal pressure, when said pressure exceeds a pre-determined operating pressure; and an airlock chamber having an inlet and an outlet operatively coupled to an inlet of said apparatus for shredding and conveying, through which material to be shredded is introduced into said apparatus for shredding and conveying said airlock chamber serving to isolate said apparatus for shredding and conveying from atmosphere.

15. The apparatus of claim 14, wherein said enclosed apparatus for shredding and conveying includes an auger for conveying material into said kiln.

16. The apparatus of claim 14, wherein said enclosed apparatus for shredding and conveying includes a shredder positioned vertically below the outlet of said airlock chamber, and a gate positioned between said airlock outlet and said shredder from controlled flow of material from said airlock chamber to said shredder.

17. The apparatus of claim 14, wherein said enclosed apparatus for shredding and conveying includes at least one oxygen sensor.

18. The apparatus of claim 14, wherein said airlock chamber includes an oxygen sensor, an inert gas supply inlet coupled to an inert gas supply, and a control system so that said airlock chamber can be purged of oxygen and replaced by an inert gas.

19. The apparatus of claim 14, wherein said enclosed apparatus for shredding and conveying includes an oxygen sensor, an inert gas supply inlet in a wall thereof that is coupled to an inert gas supply, and a control system so that oxygen in said apparatus for shredding and conveying can be purged below a predetermined level by increasing a supply of inert gas in said apparatus until said oxygen concentration is sufficiently low.

20. The apparatus of claim 14, wherein said enclosed apparatus for shredding and conveying includes a shredder for shredding material that is introduced therein and an auger for feeding material discharged from said shredder into said kiln, and an agitator positioned between said shredder and said auger to facilitate flow of shredded material from said shredder to said auger.

21. The apparatus of claim 14, wherein said pressure relief means comprises at least one rupture disk assembly.

22. The apparatus of claim 14, wherein said at least one rupture disk assembly comprises a membrane sheet secured in place by a pair of parallel flanges.

* * * * *